United States Patent [19]

Whipple

[11] 4,252,175

[45] Feb. 24, 1981

[54] CYLINDER BLOCK HAVING A CAST-IN CORE UNIT AND PROCESS FOR MANUFACTURING SAME

[75] Inventor: Roger B. Whipple, Waukegan, Ill.

[73] Assignee: Outboard Marine Corporation, Waukegan, Ill.

[21] Appl. No.: 42,509

[22] Filed: May 25, 1979

[51] Int. Cl.[3] ..... B22D 19/08

[52] U.S. Cl. ..... 164/9; 164/369; 164/99

[58] Field of Search ..... 164/9, 10, 11, 137, 164/27, 28, 23, 100, 369, 370, 332–334, 98, 99

[56] References Cited

U.S. PATENT DOCUMENTS

| | | | |
|---|---|---|---|
| 2,858,587 | 11/1958 | Leach | 164/137 |
| 2,978,764 | 4/1961 | Hrabovsky | 164/9 |
| 3,149,383 | 9/1964 | Seyffer et al. | 164/100 |
| 4,003,422 | 1/1977 | Schramm et al. | 164/9 |
| 4,077,458 | 3/1978 | Hayashi et al. | 164/369 X |
| 4,103,733 | 8/1978 | Edwards | 164/160 |

*Primary Examiner*—Robert D. Baldwin
*Assistant Examiner*—K. Y. Lin

[57] ABSTRACT

A core unit for use in casting a cylinder block of an internal combustion engine which core unit comprises a preformed cylinder liner which includes a cylindrical sidewall defining an interior bore and having a port in the sidewall. A first core unit is formed of a reducible material molded upon the preformed liner, which first core unit includes a first main core portion which partially occupies the bore and a port core portion which extends through the port. A second core unit is formed of the reducible material separately from the first core unit and is assembled upon the cylinder liner, which second core units includes a second main core portion in the bore and in mating alignment with the first main core portion, thereby forming a composite core assemblage. The composite core assemblage is placed into a cylinder block mold, and molten metal is caused to enter the cylinder block mold, thereby forming a cylinder block surrounding the composite core assemblage. The reducible material of the first and second core structures is then reduced to open the interior bore and the associated port, thereby forming a cylinder block having a cast body portion in which the cylinder liner and associated exhaust and transfer passages are all integrally cast.

16 Claims, 8 Drawing Figures

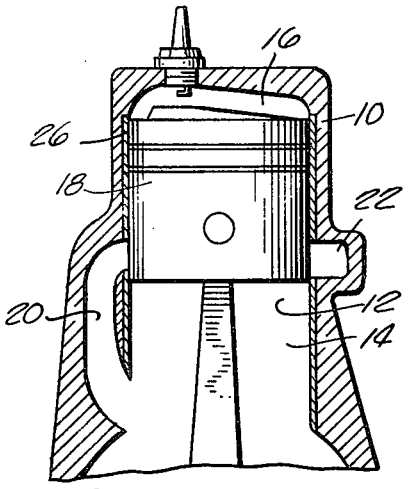
Fig. 1
Fig. 3
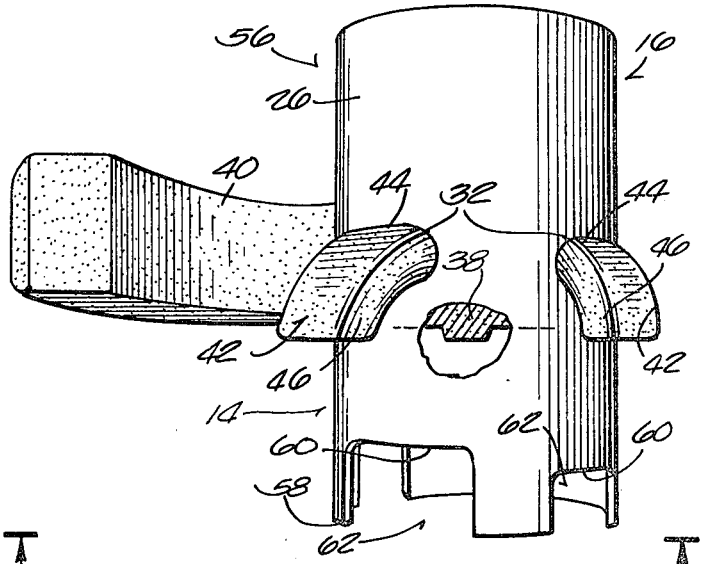
Fig. 6
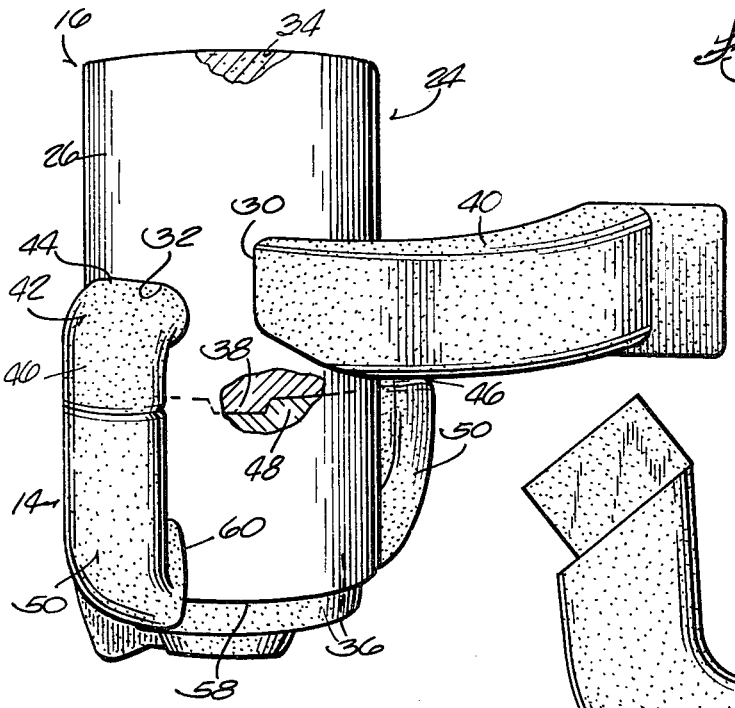
Fig. 2
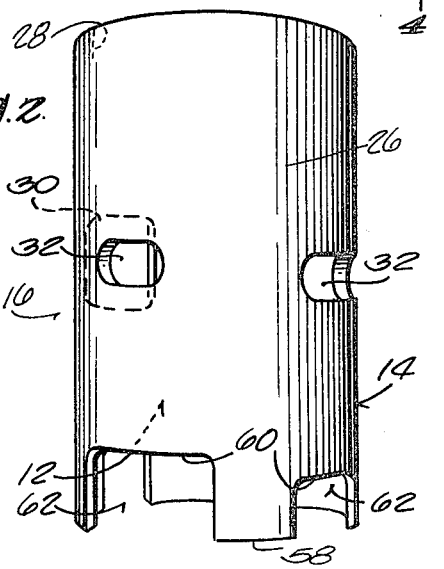
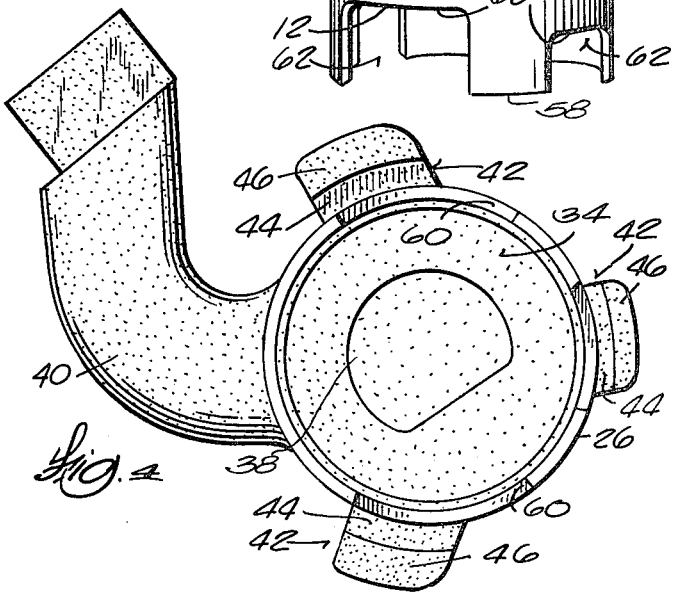
Fig. 4

CYLINDER BLOCK HAVING A CAST-IN CORE UNIT AND PROCESS FOR MANUFACTURING SAME

FIELD OF THE INVENTION

The invention relates generally to internal combustion engines and, more particularly, to devices and methods associated with casting cylinder blocks having cast-in core units which form the interior cylinder bores and passages associated therewith.

DESCRIPTION OF THE PRIOR ART

Attention is directed to the following United States Pat. Nos.

| | | |
|---|---|---|
| Leach | 2,858,587 | Nov. 4, 1958 |
| Hrabovsky | 2,978,764 | April 11, 1961 |
| Seyffer et al | 3,149,383 | Sept. 22, 1964 |
| Chramm et al | 4,003,422 | Jan. 18, 1977 |
| Hayashi et al | 4,077,458 | Mar. 7, 1978 |
| Edwards | 4,103,733 | Aug. 1, 1978 |

SUMMARY OF THE INVENTION

The invention generally provides a core unit for use in casting a cylinder block of an internal combustion engine, as well as a method of molding the core unit, a method of casting a cylinder block around the core unit, and the structure of the resulting cylinder block.

In accordance with one embodiment of the invention, the core unit comprises a cylinder liner having a cylindrical sidewall which defines an interior bore and also having a port extending through the sidewall. A first core unit is formed of a reducible material and includes a core portion located in the bore and a port core portion extending through the port.

In accordance with one embodiment of the invention, a second core unit is formed of a reducible material separately from the first core unit and includes a core portion located in the bore and together with the core portion of the first core unit substantially wholly occupies the bore.

In accordance with one embodiment of the invention, the cylinder liner has in the sidewall an exhaust port and a transfer port. In this embodiment, the first core unit includes a first main core portion which partially occupies the bore, an exhaust passage core portion which extends through the exhaust port, and a first transfer passage core portion which extends through the transfer port. In this embodiment, the second core unit includes a second main core portion located in the bore in mating alignment with the first main core portion as well as a second transfer passage core portion which is located in mating alignment with the first transfer passage core portion when the first and second main core portions are in mating alignment with each other.

In accordance with one embodiment of the invention, the interior bore which is defined by the cylinder liner sidewall has a combustion chamber portion and a crankcase portion which extends from the combustion chamber portion. In this embodiment, the first core unit occupies the combustion chamber portion, and the second core unit occupies the crankcase portion.

In accordance with one embodiment of the invention, the first transfer passage core portion includes a first portion which extends radially through the transfer port and outwardly of the first main core portion and a second portion which extends from the first core portion and in the direction of the crankcase portion of the bore. In this embodiment, the second transfer passage core portion likewise includes a first portion which extends radially outwardly of the second main core portion and a second core portion which extends from the first portion of the second transfer passage core portion and in the direction of the combustion chamber portion of the bore. Also in this embodiment, the sidewall which defines the crankcase portion of the bore includes a terminating peripheral edge and edges which extend from the peripheral edge in the direction of the combustion chamber portion and thereby define a notch in the sidewall. When the second main core portion occupies the crankcase portion of the bore, the first portion of the second transfer passage core portion is accommodated within the notch to permit mating alignment between the respective second portions of the first and second transfer passage core portions.

The invention also provides a method of molding the above described core unit. The method comprises the steps of molding the first core unit upon the preformed cylinder liner, thereby forming a first molded core assemblage, and molding the second core unit separately from the first molded core assemblage. Next, the second core unit is assembled onto the first molded core assemblage, thereby forming a composite core assemblage.

The invention also provides a method of casting a cylinder block around the above described composite core assemblage by first placing the composite core assemblage into a cylinder block mold, then causing molten metal to enter the cylinder block mold, thereby forming a cylinder block surrounding the composite core assemblage. The reducible material of the first and second core units is next reduced to open the interior bore and the associated passages.

In accordance with one embodiment of the method of casting the cylinder block, the reducible material is salt, and the step of placing the composite core assemblage into a cylinder block mold includes placing the composite salt core assemblage into a high pressure die casting machine. In this embodiment, the step of causing molten metal to enter the cylinder block mold includes injecting the molten material under pressure into the cylinder block mold. The step in this embodiment of reducing the reducible material of the first and second salt core structures includes dissolving the salt of the first and second salt core structures by means of water.

In accordance with one embodiment of the method of casting the cylinder block, the reducible material is sand, and the step of placing the composite core assemblage into a cylinder block mold includes placing the composite sand core assemblage into a permanent cylinder block mold. In this embodiment, the step of causing molten metal to enter the cylinder block mold includes pouring the molten metal into the permanent cylinder block mold. The step in this embodiment of reducing the reducible material of the first and second sand core structures includes fracturing out of the sand material of the first and second sand core structures.

In accordance with one embodiment of the invention, the resulting cylinder block includes a cast body portion, in which the cylinder liner and associated exhaust and transfer passages are all integrally cast.

One of the principal features of the invention is the provision of a cylinder block of unitary construction and having a cast-in preformed cylinder liner upon which a first core unit is molded and onto which a separately molded second core unit is assembled prior to placement of the liner and associated core units into a cylinder block mold. By virtue of this construction, the bore and associated transfer and exhaust passages are all integrally cast in the cylinder block.

Other features and advantages of the embodiments of the invention will become apparent upon reviewing the following general description, the drawings and the appended claims.

DESCRIPTION OF THE DRAWINGS

FIG. 1 is a sectional diagrammatic view of a cylinder block cast around a cast-in composite core assemblage which embodies various of the features of the invention;

FIG. 2 is a perspective view of the preformed cylinder liner which forms a part of the cast-in composite core assemblage;

FIG. 3 is a perspective view of the first core unit molded upon the preformed cylinder liner shown in FIG. 2;

FIG. 4 is a bottom view of the assembly shown in FIG. 3 and taken generally along line 4—4 of FIG. 3;

FIG. 6 is a perspective view of the cast-in composite core assemblage with the first and second core units in mating alignment;

Figure 5:
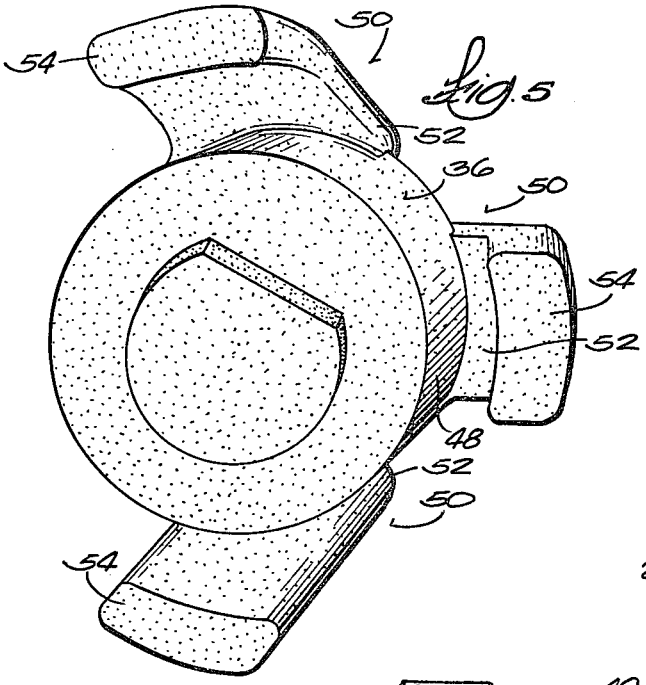
FIG. 5 is a top perspective view of the separate second core unit associated with the cast-in composite core assemblage.

Before explaining the embodiments of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Shown in FIG. 1 is a portion of a cylinder block 10 of an internal combustion engine. The block 10 defines an open cylinder bore 12 which includes a crankcase portion 14 and a combustion chamber portion 16. A piston 18 is supported in the block 10 for reciprocative movement inside the bore 12 in response to fuel ignition in the combustion chamber 16. More particularly, a combustible fuel-air mixture is introduced into the combustion chamber 16 through a transfer passage 20 which is integrally formed in the block 10 and which, in the illustrated embodiment, extends between the crankcase portion 14 and the combustion chamber portion 16 of the bore 12. Following combustion, the ignited fuel-air mixture is discharged from the combustion chamber 16 through an exhaust passage 22 which extends from the combustion chamber portion 16 of the bore 12 and which, like the transfer passage 20, is integrally formed in the block 10.

The cylinder block 10 as above described is manufactured by casting in permanent molds or in high pressure die-casting machines. In order to facilitate this casting operation, the invention provides a cast-in composite core assemblage 24 (see FIGS. 6 and 7). The composite core assemblage 24 generally includes a preformed cylinder liner 26 (see FIG. 2) which, in the illustrated embodiment, is formed of cast iron and which includes a cylindrical sidewall 28 defining the cylinder bore 12 and having in the sidewall 28 an exhaust port 30 and one or more transfer ports 32. In the illustrated embodiment (FIG. 2), three such transfer ports 32 are shown.

Figure 7:
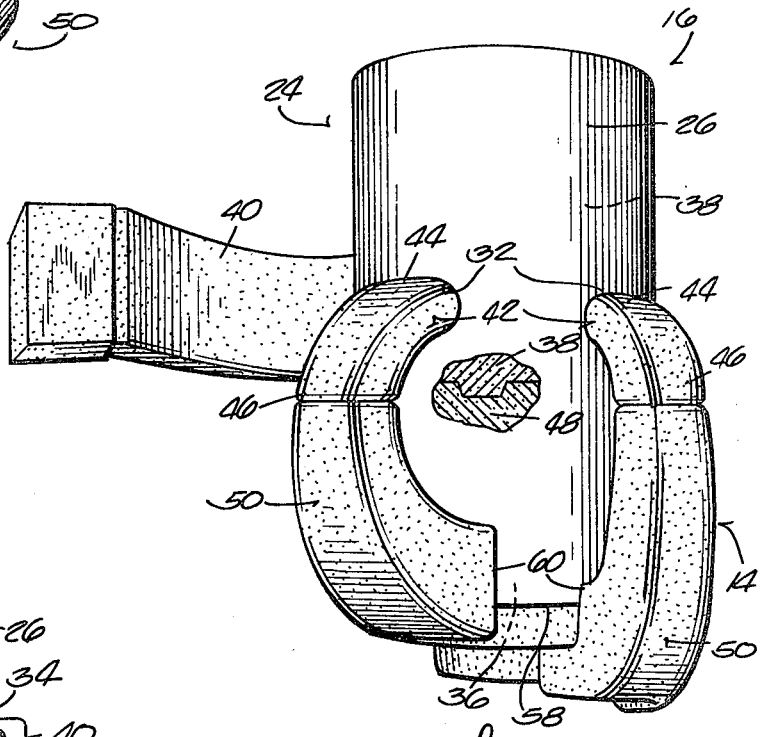
FIG. 7 is a perspective view of the cast-in composite core assemblage shown in FIG. 6 but taken from another angle.

Separate first and second core units 34 and 36 occupy the bore 12 (see FIGS. 6 and 7). Both core units 34 and 36 are formed of a reducible material, such as sand or salt, which can be molded into a desired configuration and which maintains its configuration during casting, but which may be readily reduced or removed, after casting. By virtue of the reducible core units 34 and 36 the open bore 12 and associated passages 20 and 22 may be integrally cast in the block 10.

More particularly, and referring principally to FIGS. 3 and 4, the first core unit 34 includes a first main core portion 38 which occupies the combustion chamber portion 16 of the bore 12, an exhaust passage core portion 40 which extends through the exhaust port 30, and a first transfer passage core portion 42 which extends through each transfer port 32. In the illustrated embodiment, each first transfer passage core portion 42 is configured so as to include a first portion 44 which extends radially through each transfer port 32 and a second portion 46 which extends from the first portion 44 and in the direction of the crankcase portion 14 of the bore 12.

The second core unit 36 (see FIG. 5), is molded separately from the first core unit 34 and includes a second main core portion 48 which occupies the crankcase portion 14 of the bore 12 (see FIGS. 6 and 7) in mating alignment with the first main core portion 38, and a second transfer passage core portion 52 which, like the just described first and second main core portions 42 and 48, is located in mating alignment with associated first transfer passage core portion 42. As can be seen by comparing FIG. 4 with FIG. 5, the second transfer passage core portion 50 (shown in FIG. 5) is configured so as to be generally the "mirror-image" of the first transfer passage core portion 42 (shown in FIG. 4), having a first portion 52 which extends radially outwardly of the second main core portion 48 and a second portion 54 which extends from the first portion 52 of the second transfer passage core portion 50 in the direction of the combustion chamber portion 16 of the bore 12 so as to mate with the second portion 46 of the first transfer passage core 42 (as shown in FIGS. 6 and 7).

As should be apparent, when the individual first and second core units 34 and 36 as described are in mating alignment within the liner 26, the resultant composite core assemblage 24 collectively forms the entirety of the cylinder bore 12 as well as the entirety of the associated exhaust and transfer passages 20 and 22.

While there are various methods of molding the composite core assemblage 24 and thereafter casting the cylinder block 10 around it, in the illustrated embodiment, the first core unit 34 is molded directly upon the preformed liner 26, thereby forming a first molded core assemblage 56 (as shown in FIG. 3). Next, the second core unit 36 is molded separately from the first core unit 34, and thereafter assembled onto the first molded core assemblage 56 by sliding the second core unit 36 into the crankcase portion 14 of the bore 12 until mating alignment with the first core unit 36 occurs.

To facilitate the sliding engagement of the second core unit 36 within the crankcase portion 14, the sidewall 28 which defines the crankcase portion 14 of the bore 12 includes a terminating peripheral edge 58 (see FIGS. 2 and 3) and edges 60 which extend from the peripheral edge 58 in the direction of the combustion chamber portion 14 to form a notch 62 in the bottom of the sidewall 28. The first portion 52 of each second transfer passage core portion 50 is accommodated within the notch 62 when the second core unit 36 is properly aligned with the first core unit 34 so as to mate with the first core unit 34. To secure the first and second core units 34 and 36 together, a bonding agent may be applied to the mating surfaces. The composite core assemblage 24 is thereby formed.

Figure 8:
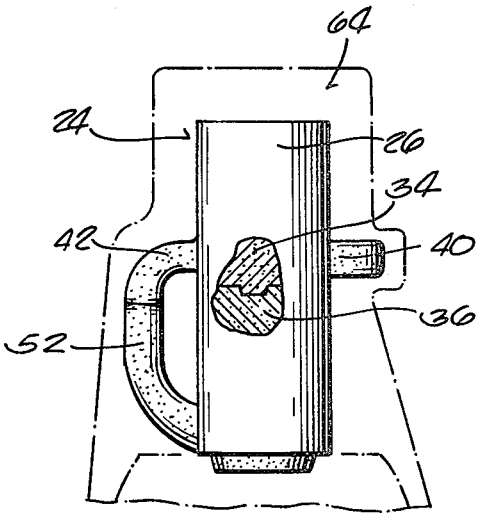
FIG. 8 is a diagrammatic view of a cylinder block mold in which the cast-in composite core assemblage is placed prior to casting.

As is shown diagrammatically in FIG. 8, the cylinder block 10 is thereafter cast around the composite core assemblage 24 (shown in FIGS. 6 and 7) by placing the composite core assemblage 24 into a suitable cylinder block mold 64 and then causing molten metal to enter the cylinder block mold 64, thereby forming the cylinder block 10 around the composite core assemblage 24.

After cooling, the reducible material may be reduced, or removed, from the first and second core units 34 and 36. The interior bore 12 and associated exhaust and transfer passages 20 and 22 are thereby opened, and the cylinder block 10 shown in FIG. 1 and as heretofore described is formed.

Various reducible materials may be used, and the selection thereof depends primarily upon the type of casting method utilized. For example, sand may be used as the reducible material, in which case the composite sand core assemblage 24 may be placed into a permanent cylinder block mold, and molten metal thereafter poured into the mold to surround the composite sand core assemblage 24. If sand is used, the step of reducing the reducible material includes fracturing out the sand material of the first and second sand core units 34 and 36 to open the bore 12 and the associated exhaust and transfer passageways 20 and 22.

Alternately, salt may be used as the reducible material, in which case the composite salt core assemblage 24 may be placed into a high pressured die-casting machine, and molten metal thereafter injected under pressure into the cylinder block mold to surround the composite salt core assemblage 24. In this case, the step of reducing the reducible salt material includes flushing the block with water to dissolve the first and second salt core units 34 and 36.

Various of the features of the invention are set forth in the following claims.

I claim:

1. A method of molding a core unit for casting a cylinder block having a cast-in preformed cylinder liner defining an interior bore and further having a passage communicating with the bore, which method comprises the steps of molding onto the preformed liner a core structure made of a reducible material and having a core portion partially occupying said bore and a passage core portion extending from said bore, thereby forming the molded core unit, molding separately from said first mentioned molded core unit a second core structure made of a reducible material, and assembling said second core structure onto said first mentioned molded core unit with said second core structure substantially wholly occupying the remainder of said bore, thereby together forming the molded core unit.

2. A method of molding a core unit for casting a cylinder block having a cast-in preformed cylinder liner defining an interior bore and further having a passage which communicates with the bore, and which extends in spaced relation from the bore, which method comprises the step of molding onto the preformed liner a core structure made of a reducible material and forming the core of a portion of the bore and of a portion of the passage which communicates with the bore and which extends in the direction of the axis of the bore in spaced relation from the liner, thereby forming the molded core unit.

3. A method according to claim 2 and further including the steps of molding separately from said first mentioned molded core unit a second core structure made of a reducible material and forming the core of the remaining portion of the bore and of the remaining portion of the passage communicating with the bore, and assembling said second core structure onto said first mentioned molded core unit with the respective core portions of the bore and the passage in mating alignment, thereby together forming the molded core unit.

4. A method of casting a cylinder block having a cast-in preformed cylinder liner defining an interior bore and further having a passage communicating with the bore, which method comprises the steps of molding onto the preformed liner a first core structure made of a reducible material and forming the core of a portion of the bore and the core of the passage communicating with the bore, thereby forming a first molded core assemblage, molding separately from said first molded core assemblage a second core structure made of a reducible material and forming the core of the remaining portion of the bore, assembling said second core structure onto said first molded core assemblage with the respective core portions of said first and second core structures substantially wholly occupying said bore, thereby forming a composite core assemblage, placing said composite core assemblage into a cylinder block mold, causing molten metal to enter said cylinder block mold, thereby forming a cylinder block surrounding said composite core assemblage, and reducing the reducible material of the first and second core structures to open the interior bore and the passage.

5. A method of casting a cylinder block having a cast-in preformed cylinder liner defining an interior bore and further having a passage communicating with the bore, which method comprises the steps of molding onto the preformed liner a first core structure made of a reducible material and forming the core of a portion of the bore and of a portion of the passage communicating with the bore, thereby forming a first molding core assemblage, molding separately from said first molded core assemblage a second core structure made of a reducible material and forming the core of the remaining portion of the bore and of the remaining portion of the passage communicating with the bore, assembling said second core structure onto said first molded core assemblage with the respective core portions of the bore and the passage in mating alignment, thereby forming a composite core assemblage, placing said composite core assemblage into a cylinder block mold, causing molten metal to enter said cylinder block mold, thereby forming a cylinder block surrounding said composite core assemblage, and reducing the reducible material of the first and second core structures to open the interior bore and the passage.

6. A method according to claim 4 or 5 wherein the reducible material is salt.

7. A method according to claim 6 wherein said step of placing said composite core assemblage into a cylinder block mold includes placing said composite salt core assemblage into a high pressure die-casting machine, wherein said step of causing molten metal to enter said cylinder block mold includes injecting the molten material under pressure into said cylinder block mold, and wherein said step of reducing the reducible material of said first and said second salt core structures includes dissolving the salt of said first and said second salt core structures by means of water.

8. A method according to claim 4 or 5 wherein the reducible material is sand.

9. A method according to claim 8 wherein said step of placing said composite core assemblage into a cylinder block mold includes placing said composite sand core assemblage into a permanent cylinder block mold, wherein said step of causing molten metal to enter said cylinder block mold includes pouring the molten metal into said permanent cylinder block mold, and wherein said step of reducing the reducible material of said first and said second sand core structure includes fracturing out the sand material of said first and said second sand core structures.

10. A core unit for use in casting a cylinder block of an internal combustion engine, said core unit comprising a cylinder liner including a cylindrical sidewall defining an interior bore and having a port extending through said sidewall, a first core unit formed of a reducible material and including a core portion in said bore and a port core portion extending through said port, and a second core unit formed of a reducible material separately from said first core unit and including a core portion in said bore and, together with said core portion of said first core unit, substantially wholly occupying said bore.

11. A core unit for use in casting a cylinder block of an internal combustion engine, said core unit comprising a cylinder liner including a cylindrical sidewall defining an interior bore and having in said sidewall an exhaust port and a transfer port, a first core unit formed of a reducible material and including a first main core portion partially occupying said bore, an exhaust passage core portion extending through said exhaust port, and a first transfer passage core portion extending through said transfer port, and a second core unit formed of a reducible material separately from said first core unit and including a second main core portion of said bore and in mating alignment with said first main core portion and a second transfer passage core portion located in mating alignment with said first transfer passage core portion when said first and said second main core portions are in mating alignment with each other.

12. A core unit according to claim 11 wherein said interior bore defined by said cylinder liner sidewall has a combustion chamber portion and a crankcase portion extending from said combustion chamber portion, wherein said exhaust port and said transfer port extend through said sidewall of said combustion chamber portion of said interior bore, wherein said first core unit occupies said combustion chamber portion, and wherein said second core unit occupies said crankcase portion.

13. A core unit according to claim 12 wherein said first core unit is molded upon said combustion chamber portion of said cylinder liner, and wherein said second core unit is slidingly engaged within said crankcase portion of said cylinder liner sleeve.

14. A core unit according to claim 12 wherein said first transfer passage core portion includes a first portion extending radially through said transfer port and outwardly of said first main core portion and a second portion extending from said first portion and in the direction of said crankcase portion of said bore, and wherein said second transfer passage core portion includes a first portion extending radially outwardly of said second main core portion and a second portion extending from said first portion of said second transfer passage core portion and in the direction of said combustion chamber portion of said bore.

15. A core unit according to claim 14 wherein said sidewall defining said crankcase portion of said bore includes a terminating peripheral edge and edges extending from said peripheral edge in the direction of said combustion chamber portion and defining a notch in said sidewall, and wherein said first portion of said second transfer passage core portion is accommodated within said notch when said second main core portion is in said crankcase portion of said bore.

16. A method of casting a cylinder block having a cast-in preformed cylinder liner defining an interior bore and further having a passage communicating with the bore, which method comprises the steps of molding onto the preformed liner a first core structure made of a reducible material and forming the core of a portion of the bore and a portion of the core of the passage communicating with the bore, thereby forming a first molded core assemblage, molding separately from said first molded core assemblage a second core structure made of a reducible material and forming the core of the remaining portion of the bore and the remaining portion of the passage, assembling said second core structure onto said first molded core assemblage with the respective core portions of said first and second core structures substantially wholly occupying said core, thereby forming a composite core assemblage, placing said composite core assemblage into a cylinder block mold, causing molten metal to enter said cylinder block mold, thereby forming a cylinder block surrounding said composite core assemblage, and reducing the reducible material of the first and second core structures to open the interior bore and the passage.

* * * * *